US010090605B2

(12) United States Patent
Chou et al.

(10) Patent No.: US 10,090,605 B2
(45) Date of Patent: Oct. 2, 2018

(54) ACTIVE PHASED ARRAY ANTENNA SYSTEM WITH HIERARCHICAL MODULARIZED ARCHITECTURE

(71) Applicant: NATIONAL CHUNG SHAN INSTITUTE OF SCIENCE AND TECHNOLOGY, Taoyuan (TW)

(72) Inventors: Hsi-Tseng Chou, Taipei (TW); Hao-Ju Huang, Taoyuan (TW); Chien-Te Yu, Taoyuan (TW)

(73) Assignee: NATIONAL CHUNG SHAN INSTITUTE OF SCIENCE AND TECHNOLOGY, Taoyuan (TW)

( * ) Notice: Subject to any disclaimer, the term of this patent is extended or adjusted under 35 U.S.C. 154(b) by 156 days.

(21) Appl. No.: 15/386,529

(22) Filed: Dec. 21, 2016

(65) Prior Publication Data

US 2018/0175514 A1 Jun. 21, 2018

(51) Int. Cl.
*H01Q 21/22* (2006.01)
*H01Q 3/26* (2006.01)

(52) U.S. Cl.
CPC ..... *H01Q 21/22* (2013.01); *H01Q 3/26* (2013.01)

(58) Field of Classification Search
CPC ..... H01Q 21/22; H01Q 3/26
See application file for complete search history.

(56) References Cited

U.S. PATENT DOCUMENTS 6,377,558 B1 * 4/2002 Dent ..... H01Q 3/40 342/354
2005/0001784 A1 * 1/2005 Oliver ..... H01Q 3/26 343/895
2014/0357319 A1 * 12/2014 Maltsev ..... G01S 3/38 455/562.1

* cited by examiner

*Primary Examiner* — Hoang Nguyen
(74) *Attorney, Agent, or Firm* — WPAT, PC

(57) ABSTRACT

An active phased array antenna system with hierarchical modularized architecture is introduced, which includes an array antenna and a beamforming circuit. The array antenna includes a plurality of antenna units, number of which is N and which are arranged in array form. The beamforming circuit is for receiving a plurality of input signals and a plurality of phase control signals, and includes a hierarchical circuit structure based on phase shifters, for outputting a plurality of output signals based on the input signals according to phase values corresponding to the phase control signals and combinations of the phase values; the output signals are respectively coupled to the antenna units so as to generate a radiation pattern, wherein number of the phase control signals is T, T<N, wherein $N=\Pi_{i=1}^{P}N_i$, $M=\Sigma_{i=1}^{P}N_i$, $M-P\leq T\leq M$, $N_i$ (i=1 to P), M, P are all positive integers, $P\geq 2$, $N_i\geq 2$.

13 Claims, 11 Drawing Sheets

ACTIVE PHASED ARRAY ANTENNA SYSTEM WITH HIERARCHICAL MODULARIZED ARCHITECTURE

FIELD OF THE INVENTION

The present invention relates to is related to an array antenna system, and in particular to an active phased array antenna system with hierarchical modularized architecture.

BACKGROUND OF THE INVENTION

In the architecture of signal processing systems, the rear end of each antenna is connected to a corresponding transmitting/receiving module and phase shifter, wherein the transmitting/receiving module includes radio frequency components such as a low noise amplifier (LNA), a power amplifier (PA) and a power attenuator. The transmitting/receiving module is used for providing power, and the array antenna and the phase shifters are for beamforming, wherein it is important that the system cost can be reduced by the reduction in the number of the transmitting/receiving modules and phase shifters.

It is noted that the conventional system architecture, in which each antenna is connected to a corresponding transmitting/receiving module and phase shifter, is not cost-effective. Specifically, in a conventional array antenna system in which each of radio frequency components antenna is digitally controlled with a corresponding control signal line (which may indicate a set of bit lines in parallel); the array antenna system requires N×M control signal lines and N×M control modules totally if the array antenna system has an array antenna of N antenna units, each antenna unit is connected to M radio frequency components, and N control modules is required for N control signal lines. Such great numbers of control signal lines and control modules not only cause a greater manufacturing cost, but also increase the circuit board real estate. In addition, excessive control signal lines and control modules may also lead to cross-interference between signals, energy loss, and increase difficulty of minimizing manufacturing process.

On the other hand, if the period of a periodic array antenna is overly large, grating lobes will be produced; the grating lobes may consume the energy of the main lobe, and thus degrading the performance of the array antenna, which is the difficulty that frequently occurs in design of array antennas.

SUMMARY OF THE INVENTION

Accordingly, an object of the invention is to provide an array antenna system, so that lines of control signals for rear-end circuit modules can be simplified.

To achieve the above object, the invention provides an active phased array antenna system with hierarchical modularized architecture, comprises: an array antenna and a beamforming circuit. The array antenna includes a plurality of antenna units, number of which is N and which are arranged in array form. The beamforming circuit is for receiving a plurality of input signals and a plurality of phase control signals. The beamforming circuit includes: a hierarchical circuit structure based on phase shifters; the hierarchical circuit structure is for outputting a plurality of output signals based on the input signals, according to phase values corresponding to the phase control signals and combinations of the phase values; the output signals are respectively coupled to the antenna units so as to generate a radiation pattern, wherein number of the phase control signals is T, $T<N$, wherein $N=\Pi_{i=1}^{P}N_i$, $M=\Sigma_{i=1}^{P}N_i$, $M-P\leq T\leq M$, $N_i$ (i=1 to P), M, P are all positive integers, $P\geq 2$, $N_i\geq 2$.

In an embodiment of the invention, the hierarchical circuit structure includes: a hierarchical phase shifter circuit, for receiving the input signals so as to output the output signals, and the hierarchical phase shifter circuit includes a plurality of phase shifters coupled hierarchically in P hierarchies; the P hierarchies of phase shifters receive P phase control signal sets, into which the plurality of phase control signals are grouped, respectively, wherein a k-th hierarchy of phase shifters in the plurality of phase shifters is for receiving at most $N_k$ phase control signals in a k-th set of the P phase control signal sets, wherein $1\leq k\leq P$.

In an embodiment of the invention, the hierarchical circuit structure includes: a hierarchical binary adder circuit and a plurality of phase shifters. The hierarchical binary adder circuit is for generating a plurality of output phase control signals according to phase values corresponding to the phase control signals and combinations of the phase values; the hierarchical binary adder circuit includes a plurality of binary adders coupled hierarchically in P−1 hierarchies. The plurality of phase shifters, coupled to the hierarchical binary adder circuit, are for outputting the output signals according to the input signals and the output phase control signals.

DETAILED DESCRIPTION OF THE PREFERRED EMBODIMENTS

To make it easier for understanding of the object, aspects, and effects according to this invention, embodiments are provided together with the attached drawings for the detailed description of the invention.

Figure 1:
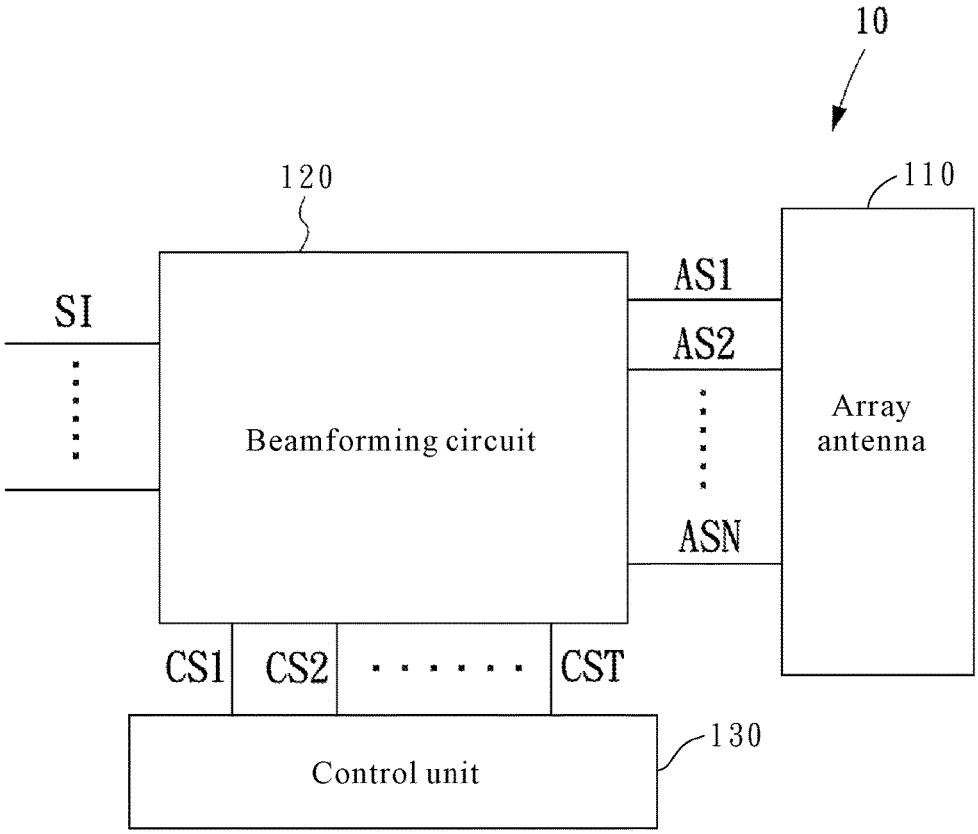
FIG. 1 is a schematic diagram illustrating the architecture of an active phased array antenna system with hierarchical modularized architecture according to an embodiment of the invention.

FIG. 1 is a schematic diagram illustrating the architecture of an active phased array antenna system with hierarchical modularized architecture (hereinafter, an array antenna system) according to an embodiment of the invention. As shown in FIG. 1, an array antenna system 10 comprises: an array antenna 110 and a beamforming circuit 120. The array antenna 110 includes a plurality of antenna units, number of which is N and which are arranged in array form. The beamforming circuit 120 is used for receiving or being coupled to a plurality of input signal SI, and a plurality of phase control signals CS1-CST, wherein the phase control signals each can be indicated by a digital serial signal or digital parallel signals. The beamforming circuit 120 includes: a hierarchical circuit structure based on phase shifters, the hierarchical circuit structure is for outputting a plurality of output signals AS1-ASN based on the input signals, according to phase values corresponding to the phase control signals and combinations of the phase values. The output signals AS1-ASN are respectively coupled to the antenna units so as to generate a radiation pattern. The number of the phase control signals CS1-CST is T; T is less than N; T and N are all positive integers.

In the present embodiment, in order to simply the control lines corresponding to control signals in the array antenna system 10, the number of the phase control signals received by the hierarchical circuit structure of the beamforming circuit 120 is less than the number of the antenna units. The hierarchical circuit structure can be designed or implemented on the basis of a notion of "hierarchical modularization", depending on the number and arrangement of the antenna unit of the array antenna 110. For the implementation of the hierarchical circuit structure, embodiments will be provided later.

Figure 2A:
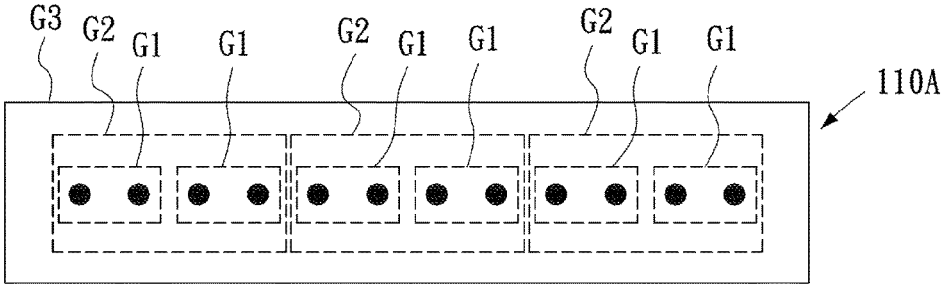
FIG. 2A and FIG. 2B illustrate examples of hierarchical modularization of an array antenna.

In the following, the meaning of application of the notion of "hierarchical modularization" to beamforming of an array antenna will be discussed first. Referring to FIG. 2A, the hierarchical modularization for a one-dimensional (or linear) array antenna 110A means that grouping is performed in a way below. The antenna units of the array antenna 110A are grouped into a plurality of subarrays $G_1$ each with $N_1$ antenna unit (e.g., $N_1$=2), which are called hierarchy one or a first hierarchy of antenna units. The subarrays $G_1$ of the hierarchy one are grouped into a plurality of subarrays $G_2$ each with $N_2$ subarrays $G_1$ (e.g., $N_2$=2), which are called hierarchy two or a second hierarchy of antenna units. Similarly, the grouping can be performed up to a last hierarchy P; the subarrays $G_{P-1}$ of the hierarchy P−1 are grouped into a subarray $G_P$ each with $N_P$ subarrays $G_{P-1}$ (e.g., $N_P$=3), which are called hierarchy P or the P-th hierarchy of antenna units; wherein P is an integer greater than or equal to 2.

It is noted that the hierarchies derived by way of "hierarchical modularization" are logical groups, and no modifications are made to the array antenna 110A physically. In addition, the above notion of the hierarchy can be relied on for the implementation of the rear-end circuit such as the beamforming circuit 120. For a hierarchy of subarray(s), a set of control signals are utilized for controlling corresponding rear-end circuit components (such as phase shifters, binary adders, or attenuators), and a hierarchical structure of the rear-end circuit components, which has combination (or superposition) effects, is employed to generate signals that are required by the antenna units of the array antenna 110A for beamforming. For example, referring to FIG. 2A, the beamforming circuit 120 can be implemented by: using $N_1$ (e.g., $N_1$=2) phase control signals to control phase values of the transmission signals fed into the subarrays G1 of the hierarchy one, respectively; using $N_2$ (e.g., $N_2$=2) phase control signals to control phase values of the transmission signals fed into the subarrays G2 of the hierarchy two, respectively; and using $N_3$ (e.g., $N_3$=3) phase control signals to control phase values of the transmission signals fed into the subarray G3 of the hierarchy three, respectively. In this way, according to the hierarchies of FIG. 2A, the rear-end circuit such as the beamforming circuit 120 can be implemented by using 7 (e.g., T=7) phase control signals for controlling 12 transmission signals required by the 12 antenna units, where $T=N_1+N_2+N_3=7$, for example. As compared to a beamforming circuit of a conventional array antenna with 12 phase control signals for achieving the same purpose, the example according to the invention has an advantage of having the number of phase control signals reduced by five; for instance, if digital phase shifters with a 5-bit resolution are employed, 60 signal lines are required for connections between phase shifters and a control unit in the above conventional approach whereas, in the example according to the invention, the number of signal lines is reduced to 35.

Further, the notion of hierarchical modularization can be extended to 3 or more hierarchies. For example, the number N of antenna units of an array antenna 110 can be expressed by: $N=N_1\times N_2\times N_3 \ldots \times N_p$ (i.e., $N=\Pi_{i=1}^{P}N_i$), and the number T of the phase control signals can be expressed by: $T=M=N_1+N_2+N_3 \ldots +N_p$ (i.e., $\Sigma_{i=1}^{P}N_i$), wherein the value of $N_i$ (where i=1 to P and $N_i\geq 2$, which are natural numbers) can be determined according to the number of hierarchy, denoted by P, of an array antenna system 10 in design. In other words, since N>M, when the number N of antenna units in an array antenna system 10 is a greater number, a greater number of hierarchies can be selected so that the number of control signals and the number of corresponding control signal lines required for the array antenna system 10 can be reduced. Additionally, the invention is limited to the above examples. For instance, the number of control signals and the number of their control signal lines can be further simplified so that the number T of phase control signals can be less than M; embodiments regarding the simplification will be provided for illustration later.

Figure 2B:
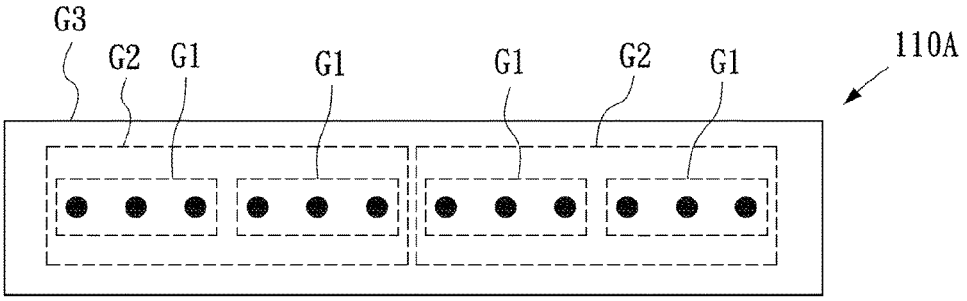

Moreover, when the notion of "hierarchical modularization" is relied on for the design of an array antenna system 10, different implementations of the beamforming circuit thereof can be produced with respect to different ways of grouping. As compared to FIG. 2A, in an example as illustrated in FIG. 2B where 3 hierarchies for the same array antenna 110A of FIG. 2A is taken, it can be determined that hierarchy one, two, and three of FIG. 2B have four subarrays G1, two subarrays G2, and one subarray G3, respectively; and correspondingly, three, two, and two phase control signals are required to control the phase values of transmission signals fed into the hierarchy one, two, and three, respectively. Thus, the beamforming circuit 120 can be implemented based on any combinations or permutations of these natural numbers $N_i$, where i=1 to P, and $N_i\geq 2$; and all of the possible implementations are regarded as some embodiments of the invention.

Different embodiments of the beamforming circuit 120 of FIG. 1 are provided in the following. The beamforming circuit includes: a hierarchical circuit structure based on phase shifters, the hierarchical circuit structure is for outputting a plurality of output signals based on the input signals, according to phase values corresponding to the phase control signals and combinations of the phase values, the output signals are respectively coupled to the antenna units so as to generate a radiation pattern. For example, the hierarchical circuit structure may be implemented by way of: a hierarchical phase shifter circuit, or a hierarchical binary adder circuit.

Firstly, the implementation of the beamforming circuit with a hierarchical phase shifter circuit is illustrated. In some embodiments, the hierarchical circuit structure includes: a hierarchical phase shifter circuit, the hierarchical phase shifter circuit is used for receiving a plurality of input signal so as to output a plurality of output signal, and includes a plurality of phase shifters coupled hierarchically in P hierarchies, wherein P≥2. The P hierarchies of phase shifters are for receiving P phase control signal sets, into which the plurality of phase control signals are grouped, respectively, wherein a k-th hierarchy of phase shifters in the plurality of phase shifters is for receiving at most $N_k$ phase control signals in a k-th set of the P phase control signal sets, wherein 1≤k≤P.

Figure 3:
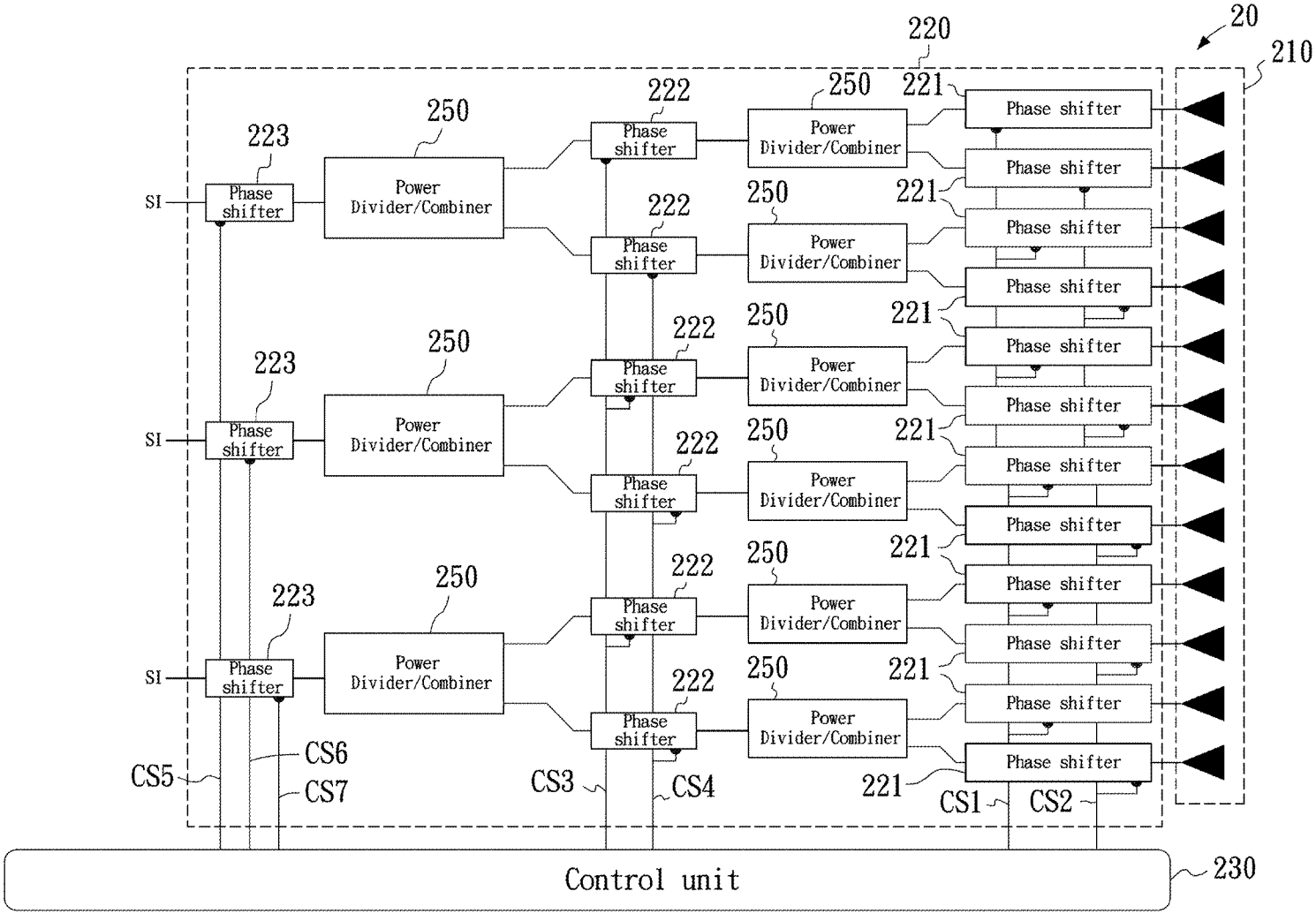
FIG. 3 is a block diagram of an embodiment of an active phased array antenna system.

Referring to FIG. 3, an embodiment of an array antenna system is illustrated in block diagram form. As shown in FIG. 3, an array antenna system 20 is provided based on the architecture of FIG. 1, and hence includes an array antenna 210 and a beamforming circuit 220. The beamforming circuit 220 includes: a hierarchical circuit structure based on phase shifters, and the hierarchical circuit structure includes a hierarchical phase shifter circuit. In the present embodiment, the array antenna 210 includes 12 antenna units, the hierarchical phase shifter circuit of the beamforming circuit 120 is implemented based on the example of FIG. 2A to which the notion of hierarchical modularization is applied, so that for a hierarchy of subarray(s), a set of control signals are utilized for controlling corresponding phase shifters, and a hierarchical structure of the phase shifters, which has combination (or superposition) effects, is employed to generate signals that are required by the antenna units of the array antenna 210 for beamforming.

In FIG. 3, the hierarchical phase shifter circuit is used for receiving 3 input signals so as to output 12 output signals, and including a plurality of phase shifters (221, 222, 223) coupled hierarchically in three hierarchies (i.e., P=3). The three hierarchies of phase shifters receive, respectively, three phase control signal sets: CS1-CS2, CS3-CS4, CS5-CS7, into which the plurality of phase control signals are grouped. Specifically, the first hierarchy of phase shifters 221 receives two phase control signals CS1-CS2 of the first phase control signal set, respectively. The second hierarchy of phase shifters 222 receives two phase control signals CS3-CS4 of the second phase control signal set, respectively. The third hierarchy of phase shifters 223 receives three phase control signals CS5-CS7 of the third phase control signal set, respectively.

In addition, as shown in FIG. 3, in the hierarchical phase shifter circuit, one of the input signals SI (e.g., a topmost input signal SI indicated on the left side of FIG. 3) is coupled to a phase shifter branch of the hierarchical phase shifter circuit, the phase shifter branch includes: three phase shifters (e.g., the topmost phase shifters 223, 222, 221 indicated in FIG. 3) respectively belonging to the first hierarchy to the third hierarchy of phase shifters, the three phase shifters and one of the antenna units (e.g., the upmost antenna unit indicated in FIG. 3) are coupled in series. Further, in the hierarchical phase shifter circuit, each input signal SI can be coupled to different antenna units via different phase shifter branches. In this way, the hierarchical phase shifter circuit employs the combinations (or superposition) of phase values of signals to generate signals required by the antenna units of the array antenna 210 for beamforming.

Moreover, for signal distribution, in the implementation of the present embodiment according to FIG. 3, the hierarchical circuit structure further includes: a plurality of power divider/combiners 250, which are coupled among the hierarchies. However, the implementation of the invention is not limited to the example; power dividers/combiners or other circuit components can be employed in the system for the generation of the signal required.

Figure 4:
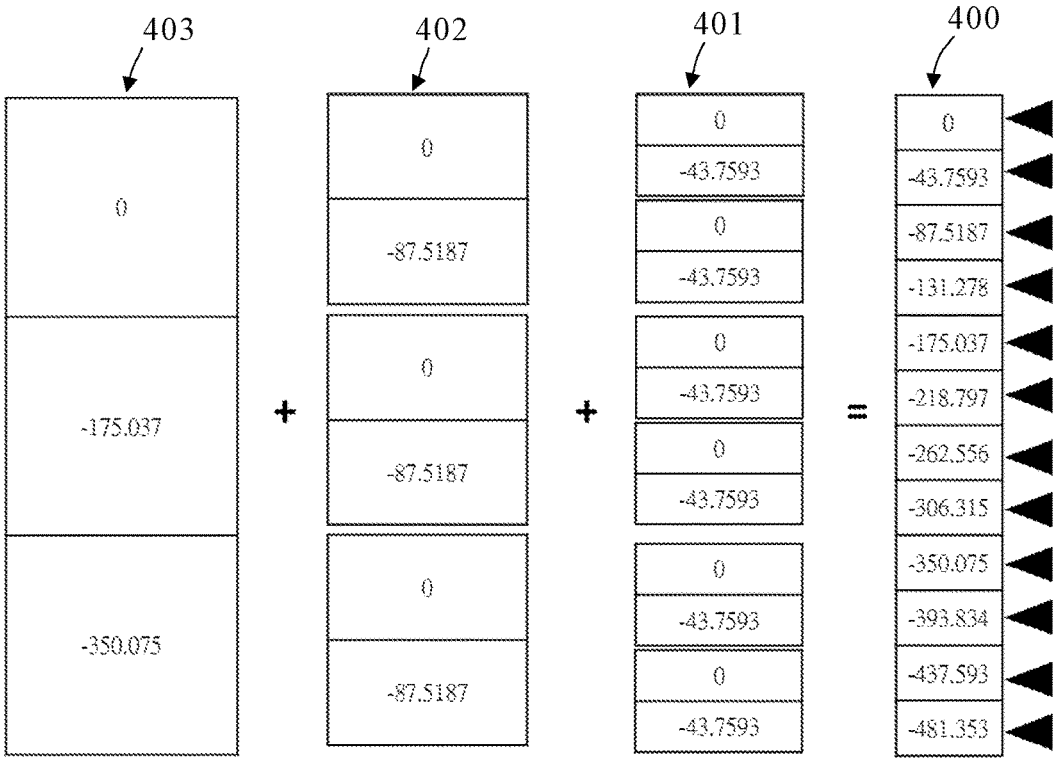
FIG. 4 is a schematic diagram illustrating an example of combinations of phase values corresponding to phase control signals by using a beamforming circuit in FIG. 3.

FIG. 4 is a schematic diagram illustrating an example of combinations of phase values corresponding to phase control signals by using a beamforming circuit in FIG. 3. As shown in the table of FIG. 4, column 401 has fields indicating phase values corresponding to two phase control signals CS1-CS2 of the first set received by the phase shifters 221 of the first hierarchy in FIG. 3, respectively. Column 402 has fields indicating phase values corresponding to two phase control signals CS3-CS4 of the second set received by the phase shifters 222 of the second hierarchy in FIG. 3, respectively. Column 403 has fields indicating phase values corresponding to three phase control signals CS5-CS7 of the third set received by the phase shifters 223 of the third hierarchy in FIG. 3, respectively. By way of the combination operations of phase shifters, 12 phase values can be obtained finally, as indicated in column 400. Thus, the hierarchical phase shifter circuit generates signals required by the 12 antenna units of the array antenna 210 for beamforming.

Please refer to FIG. 3 and FIG. 4 again, wherein beam scanning in the array antenna is based on phase differences among the signals for the antenna units; in other words, these phase values are relative values. Hence, the phase value of signal for the first antenna unit can be regarded as a phase reference, and the first phase shifter can provide a signal with a phase of zero degree. Similarly, phase references can be defined sequentially for other hierarchies of antenna units, and the phase differences with respect to the references can be provided. Accordingly, as indicated in the example of FIG. 4, some phase shifters may be required to provide phase values of zero degree.

Figure 5:
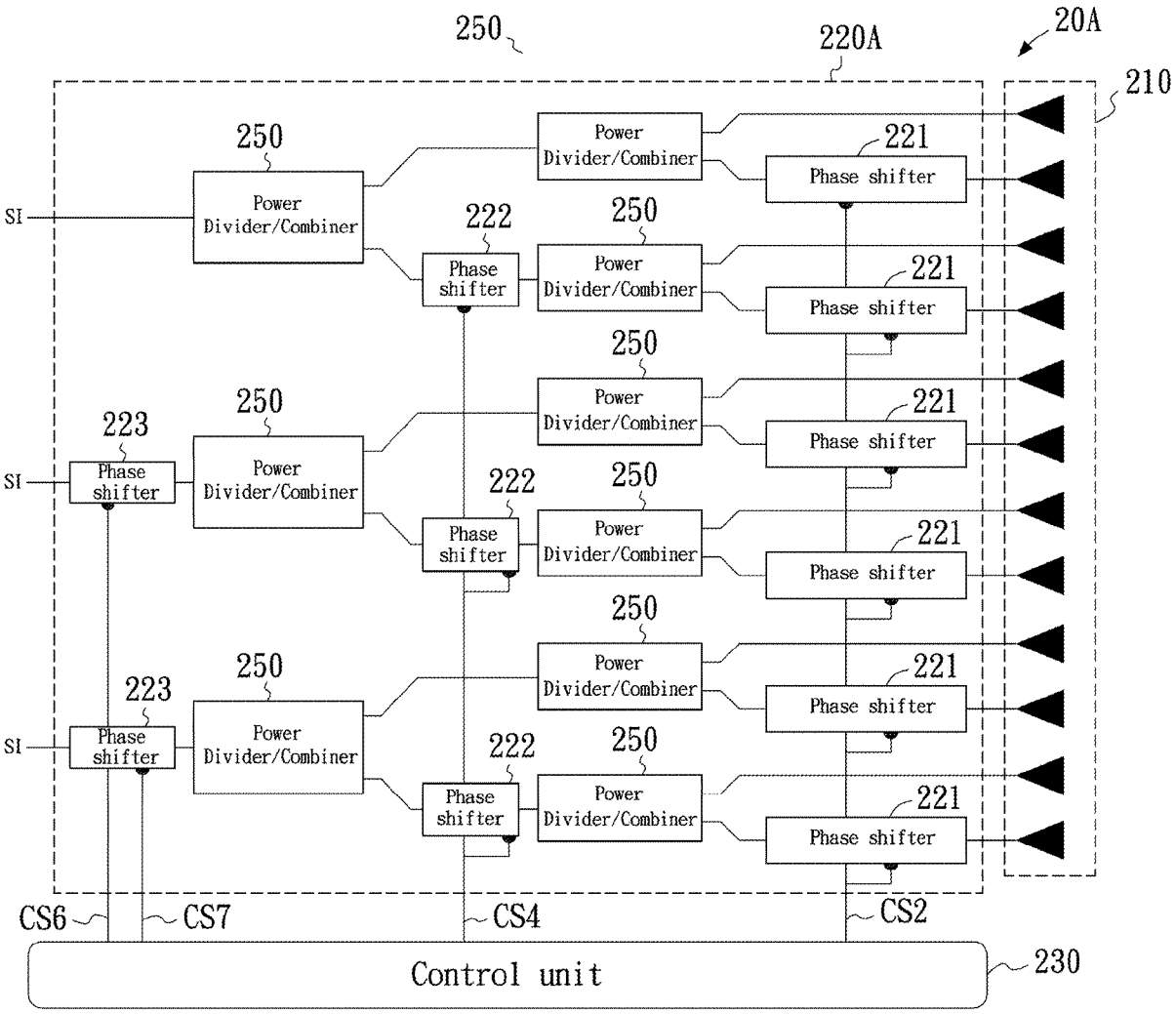
FIG. 5 is a block diagram of an embodiment of a simplified configuration of the active phased array antenna system of FIG. 3.

Further, the simplification of circuit components and control signals can be achieved by applying the notion of phase references to the above embodiments of the invention. As an example, in the embodiment of FIG. 3, the phase shifters of each hierarchy corresponding to the antenna units which are taken as phase references in each hierarchy of the array antenna 210 can be omitted so as to reduce the number of required phase shifters and the number of control signals. For example, referring back to FIGS. 3, 4 and 5, there are totally 21 phase shifters corresponding to three hierarchies in FIG. 3, and there is a phase reference in a subarray of antenna units of each hierarchy, wherein the phase references correspond to fields in FIG. 4 indicating that phases of zero degree are required. Hence, the phase shifters corresponding to the positions of these fields may be omitted selectively for simplification. As shown in FIG. 5, in a beamforming circuit 220A of an array antenna system 20A, an embodiment of a hierarchical phase shifter circuit is obtained by the omission of the phase shifters corresponding to the phase references of zero degree, according to FIGS. 3 and 4.

Table 1 indicates the comparison of the simplified configuration of the beamforming circuit of the embodiment of FIG. 5 and a conventional phase shifter circuit of the array antenna. As indicated in Table 1, compared to the conventional circuit which employs a greater number of phase control signals and phase control signal lines (wherein one phase shifter can be omitted based on one phase reference), the present embodiment requires merely about ⅓ of the number of phase control signals (or about ⅓ of the number of phase control signal lines). Thus, the notion of phase references contributes significantly to the simplification of the overall system, and the rear-end circuitry such as the implementation of the control unit 230 can also be simplified.

TABLE 1

| | Conventional circuit | Embodiment of FIG. 5 |
|---|---|---|
| Phase shifter | 11 | 11 |
| Phase control signals | 11 | 4 |
| Phase control signal lines (resolution: 5 bits) | 55 (bit lines) | 20 (bit lines) |
| Phase control signal lines (resolution: 6 bits) | 66 (bit lines) | 24 (bit lines) |

As shown in FIG. 5, due to simplification, some phase control signals in each set of phase control signals in FIG. 3 can be omitted, and in FIG. 5, the phase control signals CS1, CS3, and CS5 in FIG. 3 have been omitted. Hence, in FIG. 5, the number of the phase control signals required by the phase shifters is 4, where T=M−P=7−3=4.

In addition, due to simplification, in the hierarchical phase shifter circuit as shown in FIG. 5, there is one of the input signals (e.g., the topmost input signal SI indicated in FIG. 5) is coupled to a phase shifter branch of the hierarchical phase shifter circuit; and the phase shifter branch is coupled to one of the antenna units (e.g., the topmost antenna unit in FIG. 5). Further, in the hierarchical phase shifter circuit, one of the input signals (e.g., the input signals SI other than the topmost one, indicated in FIG. 5) is coupled to a phase shifter branch of the hierarchical phase shifter circuit; the phase shifter branch includes: q phase shifters of the first hierarchy to the P-th hierarchy of phase shifters (e.g., P=3); and the q phase shifters and one of the antenna units (e.g., the antenna units other than the topmost one, indicated in FIG. 5) are coupled in series, wherein $1 \le q \le P$.

Certainly, the implementation of the invention is not limited to the examples according to FIG. 5; for instance, any other antenna unit (other than the topmost one) can be made as a phase reference of antenna unit; or the phase value of the phase reference can be defined by zero or a different value; or a portion of phase shifters remain selectively after simplification; all of the instances or any possible modifications are regarded as some embodiments of the invention.

Figure 6:
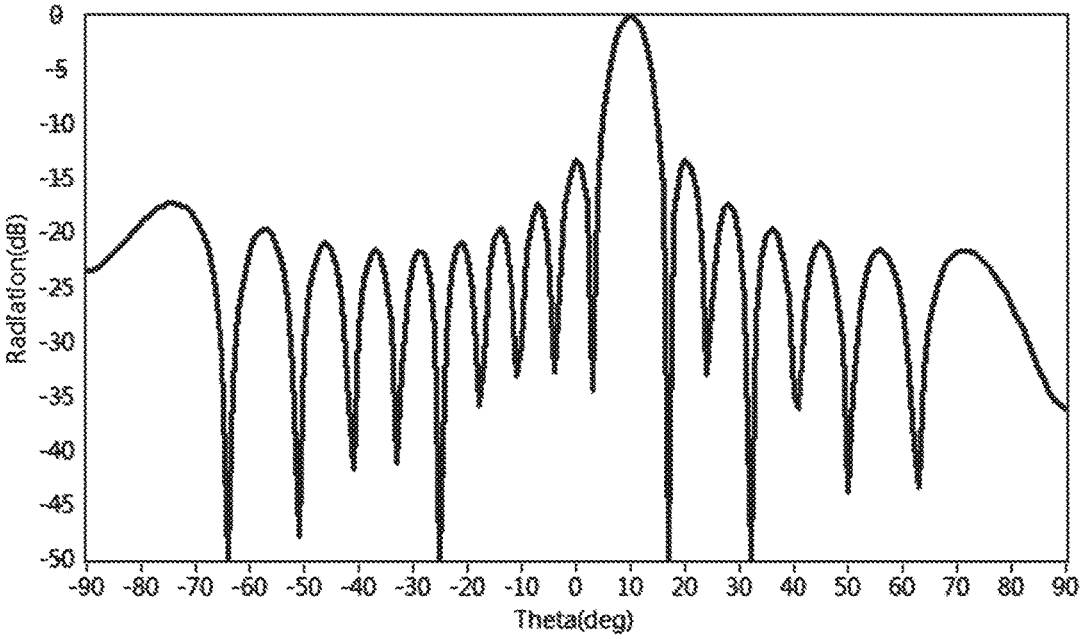
FIG. 6 is a radiation power pattern obtained by the active phased array antenna system of FIG. 3 or FIG. 4 according to the phase values in FIG. 4.

FIG. 6 is a radiation power pattern obtained by the active phased array antenna system of FIG. 3 or FIG. 4 according to the phase values in FIG. 4, wherein array antenna 210 achieves beamforming with an offset angle of 10 degrees.

The following illustrates the implementation of the beamforming circuit employing a hierarchical binary adder circuit.

In some embodiments, the hierarchical circuit structure includes: a hierarchical binary adder circuit and a plurality of phase shifters. The hierarchical binary adder circuit is used for generating a plurality of output phase control signals according to phase values corresponding to the phase control signals and combinations of the phase values, the hierarchical binary adder circuit includes a plurality of binary adders coupled hierarchically in P−1 hierarchies. The phase shifters, coupled to the hierarchical binary adder circuit, are employed to output the output signals according to the input signals and the output phase control signals, wherein $P \ge 2$.

Figure 7:
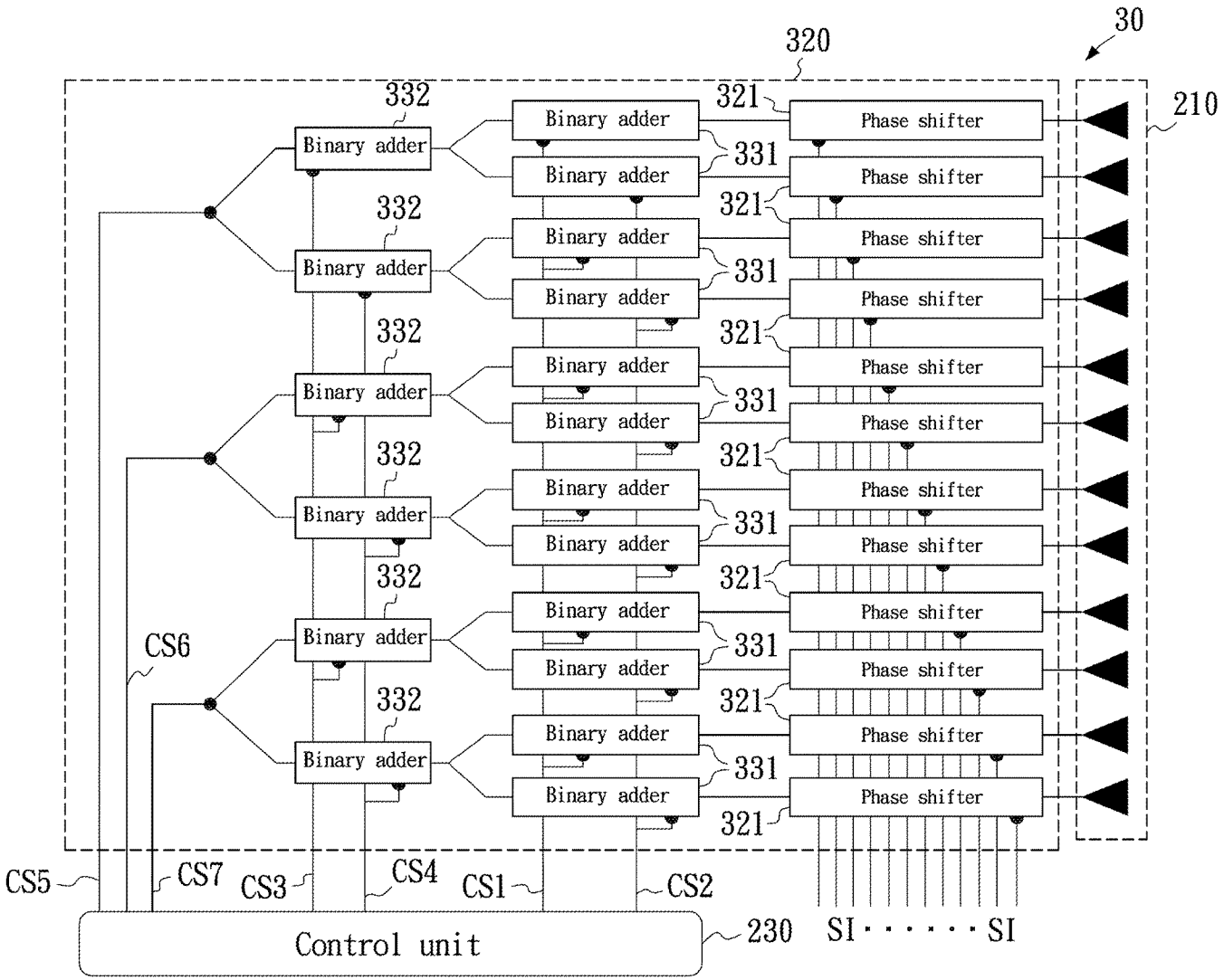
FIG. 7 is a block diagram of another embodiment of an active phased array antenna system.

FIG. 7 is a block diagram of another embodiment of an active phased array antenna system. As illustrated in FIG. 7, an array antenna system 30 is implemented based on the architecture of FIG. 1, and includes an array antenna 210 and a beamforming circuit 320. The hierarchical circuit structure based on phase shifters of the beamforming circuit 320 includes: a hierarchical binary adder circuit and a plurality of phase shifters 321; and the hierarchical binary adder circuit includes a plurality of binary adders 331 and 332, coupled hierarchically in P−1 hierarchies (e.g., P=3). In the present embodiment, the beamforming circuit 320 is implemented based on the example of FIG. 2A to which the notion of hierarchical modularization is applied, so that for a hierarchy of subarray(s), a set of control signals are utilized for controlling corresponding binary adders, and a hierarchical structure of the binary adders for the combination (or superposition) operations is employed to control the phase shifters, so as to generate signals that are required by the antenna units of the array antenna 210 for beamforming.

In FIG. 7, the P−1 (e.g., P=3) hierarchies receive a first to a (P−1)th phase control signal set in the P phase control signal sets, respectively, wherein a k-th hierarchy of binary adders of the plurality of binary adders (e.g., the binary adders 331 of the first hierarchy) are for receiving at most $N_k$ phase control signals in a k-th set of the P phase control signal sets (e.g., the phase control signals CS1-CS2 of the first set), wherein $1 \le k \le P-1$. In addition, as illustrated in FIG. 7, the (P−1)th hierarchy of binary adders (e.g., the binary adders of the second hierarchy) are further for receiving at most $N_p$ phase control signals (e.g., the phase control signals CS5-CS7 of the third hierarchy) in the P-th phase control signal set.

Further, in the hierarchical binary adder circuit illustrated in FIG. 7, a phase control signal of the Pth phase control signal set of the plurality of control signals (e.g., CS5 of the third set) is coupled to a binary adder branch of the hierarchical binary adder circuit. The binary adder branch includes: P−1 binary adders (e.g., the binary adders 332 and 331 in the second and first hierarchies) respectively belonging to the first hierarchy to the (P−1)th hierarchy of binary adders; and the P−1 binary adders and one of the phase shifters (e.g., the lowermost phase shifter 321 indicated in FIG. 7) are coupled in series.

Figure 8:
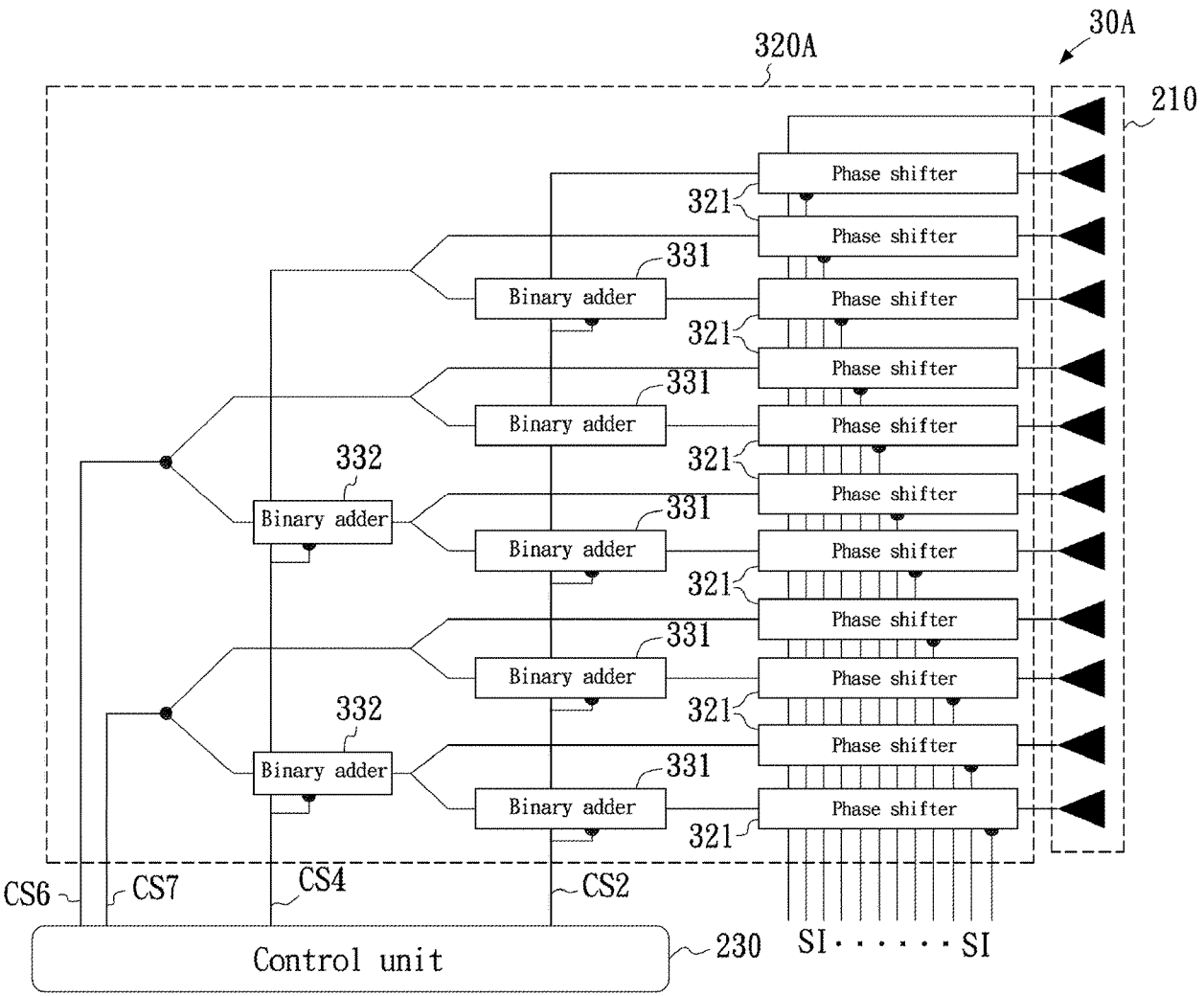
FIG. 8 is a block diagram of an embodiment of a simplified configuration of the active phased array antenna system of FIG. 7.

Further, the simplification of circuit components and control signals can be achieved by applying the notion of phase references to the embodiment of FIG. 7 and other embodiments based on FIG. 7. FIG. 8 is a block diagram of an embodiment of a simplified configuration of the array antenna system of FIG. 7. Since the embodiment of FIG. 7 is based on the principle of combination operations, the embodiment of FIG. 4 can be also adopted for controlling. Thus, the simplified circuit structure in FIG. 8 is achieved by the simplification of the embodiment of FIG. 7 according to the approach illustrated in the embodiment of FIG. 5, wherein some of the binary adders in FIG. 7 are omitted.

For example, in a hierarchical binary adder circuit of a beamforming circuit 320A of an array antenna system 30A as illustrated in FIG. 8, a phase control signal (e.g., CS6 in FIG. 8) of the P-th phase control signal set of the phase control signals can be coupled to a binary adder branch (or a circuit branch) of the hierarchical binary adder circuit; and the binary adder branch is coupled to one of the phase shifters (e.g., the fourth phase shifter in FIG. 8).

In another example, in the hierarchical binary adder circuit of the array antenna system 30A as illustrated in FIG. 8, a phase control signal (e.g., CS6 in FIG. 8) of the P-th phase control signal set of the plurality of control signals can be coupled to a binary adder branch of the hierarchical binary adder circuit. The binary adder branch includes: q binary adders of the first hierarchy to the (P−1)th hierarchy of binary adders; and the q binary adders and one of the phase shifters are coupled in series, wherein $1 \le q < P-1$.

The array antenna systems according to the embodiments of the invention have advantages of requiring the reduced numbers of control signals and control signal lines for controlling rear-end circuit modules over the conventional system in which each antenna unit requires one rear-end circuit module. In addition, according to the invention, the read-end circuit modules indicate not only phase shifters, but also any radio frequency components, which can be employed or replaced, within the scope of understanding of one of ordinary skill in the art of the invention. For example, radio frequency components, such as low noise amplifiers, power amplifiers, and power attenuators, or any combinations thereof, can be controlled by using control signals, the number of which is less than the number of the antenna units, thereby leading to the simplification of the overall circuit, according to the invention. Further, the embodiments, based on P=3 as above, can be extended to any embodiments with P>3; for instance, for an array antenna with N antenna unit, where N=60, when N=5*3*2*2 is taken, a beamforming circuit corresponding to four hierarchies of the antenna units can be realized, for example, based on a hierarchical phase shifter circuit or a hierarchical binary adder circuit. For N=72, when N=3*3*2*2*2 may be taken, a beamforming circuit corresponding to five hierarchies of the antenna units can be realized, for example.

Moreover, in some embodiments, the array antenna system according to invention may further include a control unit 230, and the beamforming circuit is controlled by using the control unit digitally. The control unit 230 may be implemented by using one or more circuits such as a microprocessor, digital signal processor, or a programmable integrated circuit such as a microcontroller, field programmable gate array (FPGA), or application specific integrated circuit (ASIC), or using dedicated circuitry or module.

In implementation, any algorithm of beamforming can be utilized for generating a desired radiation pattern according to the notion of hierarchical modularization, and optionally accompanied with an optimization algorithm, such as any of particle swarm optimization, differential algorithm, dynamic difference algorithm, electromagnetic-like algorithm, or genetic algorithm, to compute optimal parameters such as phases and/or amplitudes of signals for the antenna units of the array antenna. The parameters in the form of one or more tables can be stored in advance, or downloaded from an external source, into the control unit 230, or a memory unit of the control unit 230. In this way, during operation of the array antenna system according to the invention, the control unit 230 can generate corresponding control signals such as the above phase control signals for beamforming, based on parameters such as the phases and/or amplitudes of signals for the antenna units obtained by way of looking up one or more look-up tables. However, the implementation of the invention is not limited thereto. For example, in another embodiment, the control unit 230 is configured to compute any algorithm of beamforming for producing a desired radiation pattern according to the notion of hierarchical modularization, and accordingly generating parameters such as phases and/or amplitudes of signals for the antenna units, so as to obtain corresponding control signals such as the above phase control signals for beamforming. For instance, genetic algorithm, or other algorithm for the same optimization purpose, can be employed. During computation of the genetic algorithm, parameters are converted into a chromosome indicated in data bits, and a table is established for reference purpose. Such way corresponds to parameters for digital components, and hence the genetic algorithm can be adopted to compute optimal parameters required for beamforming of the desired radiation pattern. Accordingly, the phase shifters and/or attenuators for beamforming in the array antenna system can be controlled.

In the following, embodiments are provided in which the notion of hierarchical modularization of antenna units are applied and extended to two-dimensional array antenna system.

Figure 9:
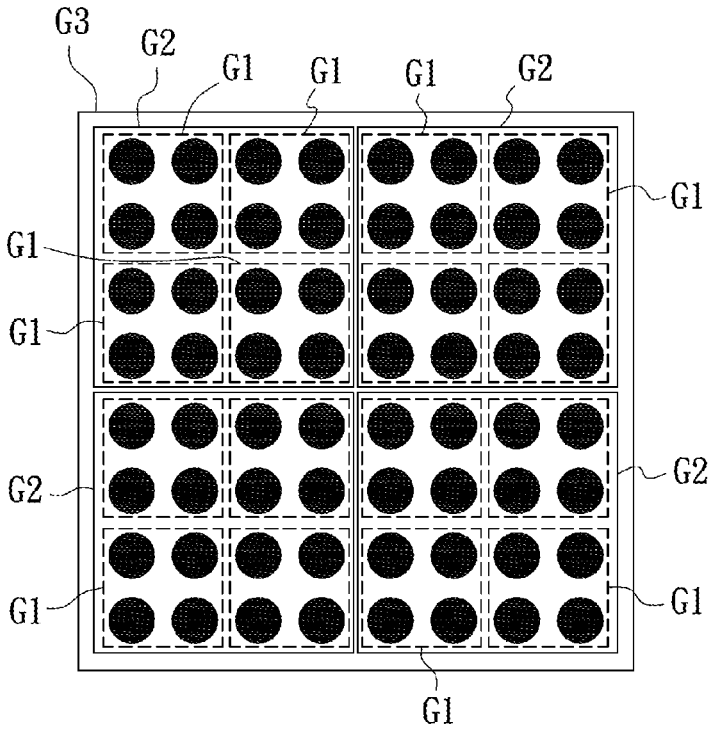
FIG. 9 illustrates an example of hierarchical modularization of an array antenna of two dimensions.

As an example, a two-dimensional array antenna is taken, the number of the antenna units of which is denoted by $N=N_x \times N_y$. The antenna units can be grouped in three hierarchies, such as a two-dimensional array antenna illustrated in FIG. 9, wherein N=64=8×8, $N_x$=8=2×2×2, $N_y$=8=2×2×2, three hierarchies can be obtained as, for instance, a first hierarchy of subarrays G1, a second hierarchy of subarrays G2, a third hierarchy of subarray G3; however, the invention is not limited thereto. The total radiation of the array antenna formed by the summation of radiation of the antenna units can be expressed by:

$$\vec{E}_{tot} = \sum_{m=0}^{N_y-1} \sum_{n=0}^{N_x-1} a_{nm}^{(0)} e^{j\phi_{nm}^{(0)}} e^{jk\hat{r}\cdot\vec{r}'_{nm}} \vec{E}_{ele}(\theta, \phi) \tag{1}$$

wherein $\vec{E}_{ele}(\theta,\phi)$ indicates the radiation of each antenna unit, $a_{nm}^{(0)}$ and $\phi_{nm}^{(0)}$ denotes the $nm^{th}$ excitation amplitude and phase respectively, "0" indicates the $0^{th}$ level. The array antenna unit before grouping can be expressed by way of:

$$\vec{r}_{nm} = ndx\hat{x} + mdy\hat{y} + \vec{r}_{ref} \tag{2}$$

wherein $\vec{r}_{ref}$ indicates a position of an antenna unit taken as a reference point in the array antenna, that is, the position of the antenna unit when m=n=0. If $\vec{E}_{ele}(\theta,\phi)$ indicates the antenna radiation of the antenna unit at the origin of the coordinates, then formula (1) can be expressed into:

$$\vec{E}_{tot} = \vec{E}_{ele}(\theta, \phi) e^{jk\hat{r}\cdot\vec{r}'_{ref}} \left\{ \sum_{m=0}^{N_y-1} \sum_{n=0}^{N_x-1} a_{nm}^{(0)} e^{j\phi_{nm}^{(0)}} e^{j(k_x ndx + k_y mdy)} \right\} \tag{3}$$

wherein $$\sum_{m=0}^{N_y-1} \sum_{n=0}^{N_x-1} a_{nm}^{(0)} e^{j\phi_{nm}^{(0)}} e^{j(k_x ndx + k_y mdy)}$$

is the array factor (AF); $k_x = k\sin(\theta)\cos(\phi)$, $k_y = k\sin(\theta)\sin(\phi)$ indicate the projections on the directions of radiation, or called k-domain; θ and ϕ denote directions of a "visible space"; the number of the antenna units can be grouped into three hierarchies where $N_x = N_1^x \times N_2^x \times N_3^x$, $N_y = N_1^y \times N_2^y \times N_3^y$.

The first hierarchy of antenna units can be expressed by:

$$\vec{E}_{s,1} = \left\{ \sum_{n_1=0}^{N_1^x-1} \sum_{m_1=0}^{N_1^y-1} a_{n_1,m_1}^{(1)} e^{j\phi_{n_1,m_1}^{(1)}} e^{j(k_x n_1 dx + k_y m_1 dy)} \right\} \vec{E}_{ele} \cdot e^{jk\hat{r}\cdot\vec{r}'_{ref}} \tag{4}$$

The second hierarchy of antenna units can be expressed by:

$$\vec{E}_{d,1}(\theta,\phi)=\left\{\sum_{n_2=0}^{N_2^x-1}\sum_{m_2=0}^{N_2^y-1}a_{n_2,m_2}^{(2)}e^{j\phi_{n_2,m_2}^{(2)}}e^{j(k_x n_2 dx^{(1)}+k_y m_2 dy^{(1)})}\right\}\vec{E}_{s,1}(\theta,\phi) \tag{5}$$

wherein $dx^{(1)}=N_1^x dx$, $dy^{(1)}=N_1^y dy$.

The third hierarchy of antenna units can be expressed by:

$$\vec{E}_{tot}(\theta,\phi)=\left\{\sum_{n_3=0}^{N_3^x-1}\sum_{m_3=0}^{N_3^y-1}a_{n_3,m_3}^{(3)}e^{j\phi_{n_3,m_3}^{(3)}}e^{j(k_x n_3 dx^{(2)}+k_y m_3 dy^{(2)})}\right\}\vec{E}_{d,1}(\theta,\phi) \tag{6}$$

wherein $dx^{(2)}=N_2^x dx^{(1)}=N_2^x N_1^x dx$, $dy^{(2)}=N_2^y dy^{(1)}=N_2^y N_1^y dy$.

Based on the formulas (4)-(6), the phase values required for beamforming can be derived as:

$$\begin{cases}\phi_{n1,m1}^{(1)}=-k_x^{(0)}n_1 dx-k_y^{(0)}m_1 dy\\ \phi_{n2,m2}^{(2)}=[-k_x^{(0)}n_2 N_1^x dx]+[-k_y^{(0)}m_2 N_1^y dy]\\ \phi_{n3,m3}^{(3)}=-k_x^{(0)}n_3 N_2^x N_1^x dx-k_y^{(0)}m_3 N_2^y N_1^y dy\end{cases} \tag{7}$$

where $k_x^{(0)}$, $k_y^{(0)}$, indicate the $0^{th}$ level of k-domain.

Thus, according to the formula (7), the phase values required for beamforming can be derived for the two-dimensional array antenna system. In this way, a control unit can be employed to control phase shifters of the rear-end circuitry, so as to drive the array antenna according to the formula (6) for a desired radiation pattern.

In an example, an array antenna may employ 5-bit digital attenuators and phase shifters as the rear-end circuitry. In the present example, ratios of input energy to the antenna units of the array antenna can be adjusted by controlling the digital attenuators, wherein 5 bits indicate $2^5=32$ steps, and the power can be adjusted in terms of 0 to −31 dB. In addition, phase values of signals to the antenna units of the array antenna can be adjusted by controlling the phase shifters, wherein 5 bits indicate $2^5=32$ steps, and the phase resolution can be adjusted in terms of 32 steps, accordingly. As such, for any of the embodiments of the array antenna system, a control unit can be employed to control the rear-end circuit modules digitally for beamforming. The implementation of the invention is not limited to the components such as phase shifters; for example, serially-controlled digital phase shifters can also be employed in any embodiments of the invention.

Figure 10A:
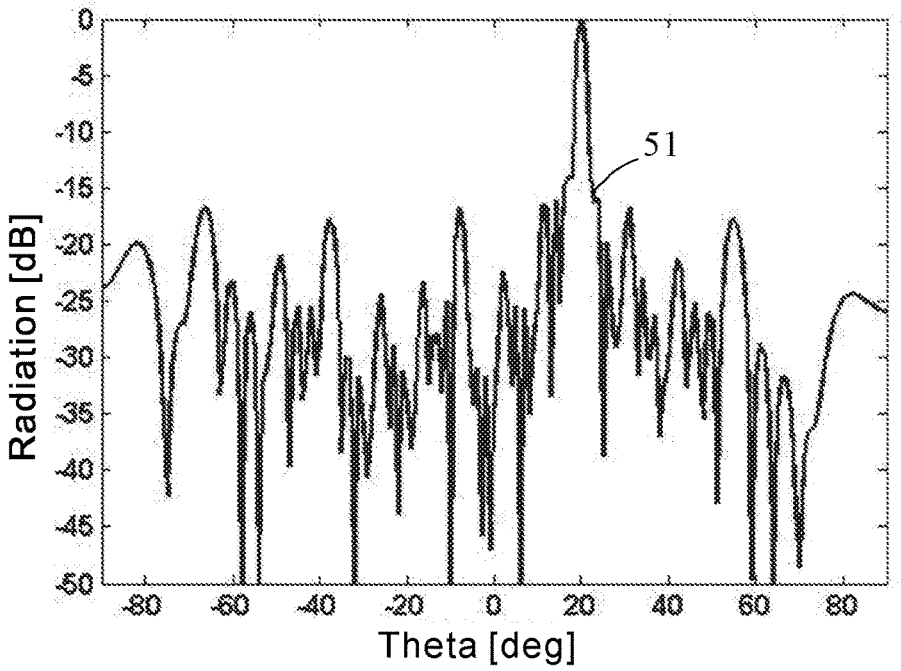
FIG. 10A is a radiation power pattern chart obtained by simulation for an active phased array antenna system according to an embodiment of the invention.
Figure 10B:
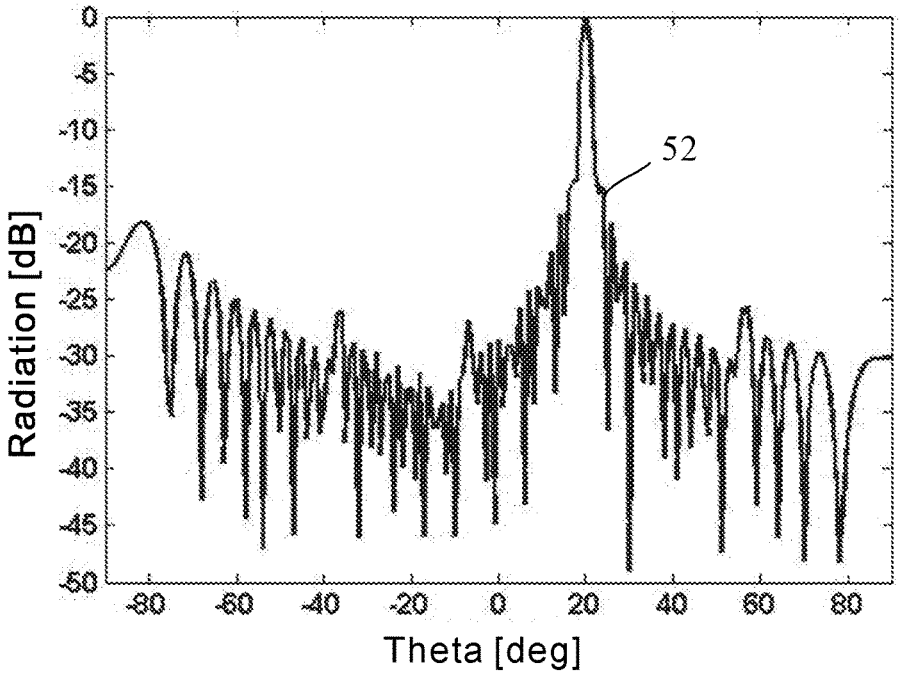
FIG. 10B is a radiation power pattern chart obtained by simulation for a conventional array antenna system.

Further, in an embodiment, an array antenna system is implemented according to the architecture of FIG. 3 (or FIG. 5), with an array antenna of 36 antenna units, wherein N=36=3×3×4, and three hierarchy is taken, i.e., P=3. Ten (or seven) control signal lines for phase shifters, where T=M=10 (or T=M−P=7; P=3). In addition, it is required that the main lobe of the antenna scans to an angle of θ (theta) of 20 degrees, and the genetic algorithm is employed to determine the phase values required. As shown in FIG. 10A, a curve 51 indicates a radiation power pattern obtained by simulation for the array antenna system according to the present embodiment. On the other hand, an simulation is also performed for an array antenna system based on the conventional architecture using 36 phase control lines for controlling 36 phase shifters, wherein conjugation phase is applied and it is also required that the main lobe of the antenna scans to an angle of θ of 20 degrees. As illustrated in FIG. 10B, a curve 52 indicates a radiation power pattern obtained by simulation for the conventional array antenna system. By comparison, in the present embodiment, the number of control signal lines is reduced from 36 (conventional) to 10 or 7, and beam scanning can be achieved with better side lobes suppression.

Figure 11A:
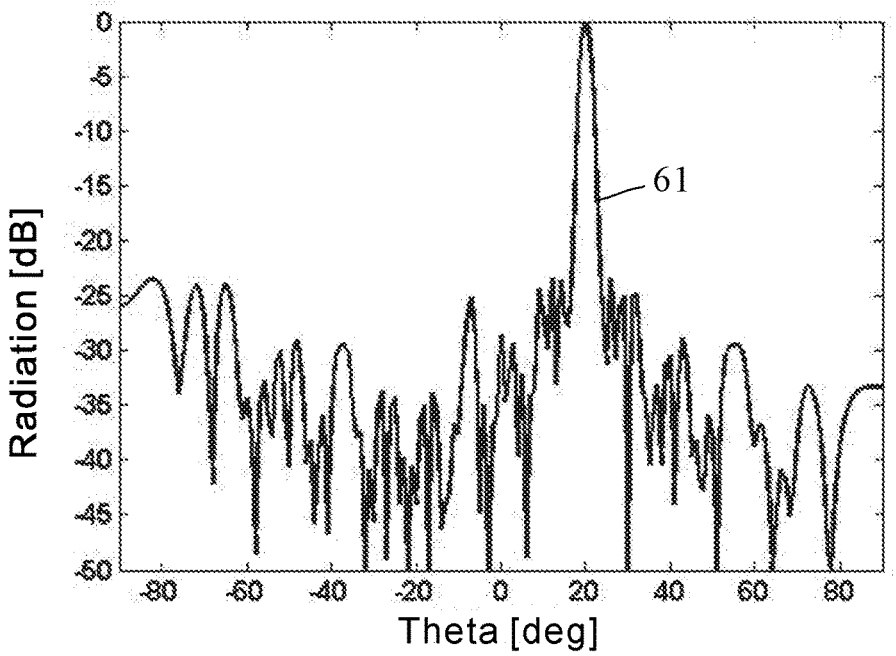
FIG. 11A is a radiation power pattern chart obtained by simulation for an active phased array antenna system according to another embodiment of the invention.
Figure 11B:
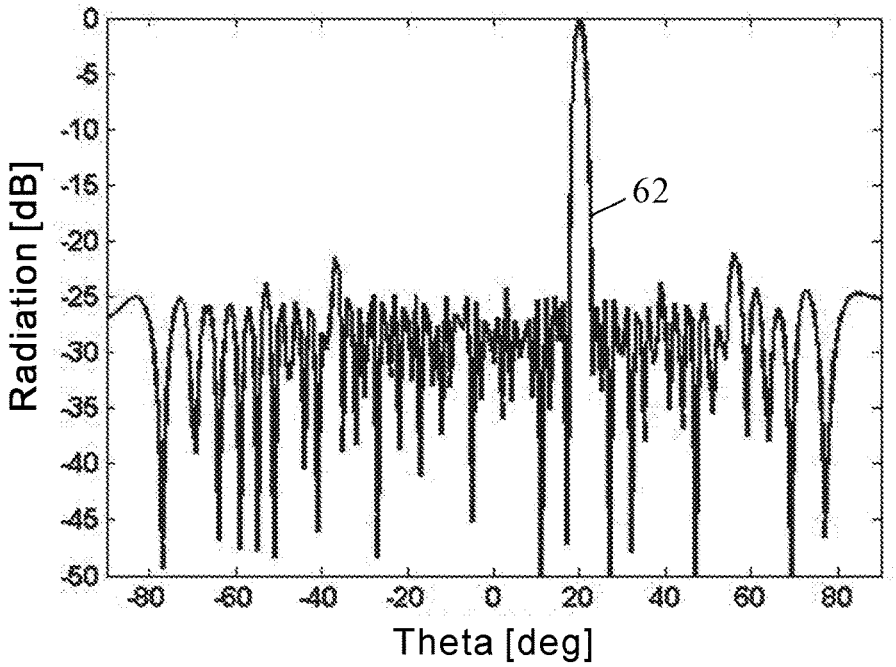
FIG. 11B is a radiation power pattern chart obtained by simulation for another conventional array antenna system.

Further, in another embodiment, an array antenna system is implemented according to the same architecture of the embodiment related to FIG. 10A, with a beamforming circuit which employs and controls attenuators accompanied with phase shifters, for beamforming and side lobes suppression; wherein it is required that the main lobe of the antenna scans to an angle of θ of 20 degrees, and the genetic algorithm is employed to determine the phase values required. As shown in FIG. 11A, a curve 61 indicates a radiation power pattern obtained by simulation for the array antenna system according to the present embodiment. On the other hand, an simulation is also performed for an array antenna system based on the conventional architecture using 36 phase control lines for controlling 36 phase shifters, wherein Tschebyscheff Taper and conjugation phase are applied and it is also required that the main lobe of the antenna scans to an angle of θ of 20 degrees. As illustrated in FIG. 11B, a curve 62 indicates a radiation power pattern obtained by simulation for the conventional array antenna system. By comparison, in the present embodiment, the beamforming circuit requires reduced numbers of control signal lines for the phase shifters and attenuators, and beam scanning can be achieved with accurate direction of the main lobe and better side lobes suppression.

While the invention has been described by means of specific embodiments, numerous modifications and variations could be made thereto by those skilled in the art without departing from the scope and spirit of the invention set forth in the claims.

What is claimed is:

1. An active phased array antenna system with hierarchical modularized architecture, comprising:

an array antenna, including a plurality of antenna units, number of which is N and which are arranged in array form; and a beamforming circuit, for receiving a plurality of input signals and a plurality of phase control signals, comprising: a hierarchical circuit structure based on phase shifters, for outputting a plurality of output signals based on the input signals, according to phase values corresponding to the phase control signals and combinations of the phase values, wherein the output signals are respectively coupled to the antenna units so as to generate a radiation pattern, and number of the phase control signals is T, T<N, $N=\Pi_{i=1}^{P}N_i$, $M=\Sigma_{i=1}^{P}N_i$, M−P≤T≤M, $N_i$ (i=1 to P), M, P are all positive integers, P≥2, $N_i\geq 2$.

2. The active phased array antenna system as claimed in claim 1, wherein the hierarchical circuit structure comprises:

a hierarchical phase shifter circuit, for receiving the input signals and outputting the output signals, including a plurality of phase shifters coupled hierarchically in P hierarchies, the P hierarchies of phase shifters being for receiving P phase control signal sets, into which the plurality of phase control signals are grouped, respectively, wherein a k-th hierarchy of phase shifters in the plurality of phase shifters is for receiving at most $N_k$ phase control signals in a k-th set of the P phase control signal sets, wherein $1 \leq k \leq P$.

3. The active phased array antenna system as claimed in claim 2, wherein in the hierarchical phase shifter circuit, a first one of the input signals is coupled to a first phase shifter branch of the hierarchical phase shifter circuit, the first phase shifter branch includes: P phase shifters respectively belonging to the first hierarchy to the Pth hierarchy of phase shifters, the P phase shifters and a first one of the antenna units are coupled in series.

4. The active phased array antenna system as claimed in claim 3, wherein in the hierarchical phase shifter circuit, another one of the input signals is coupled to another phase shifter branch of the hierarchical phase shifter circuit, the another phase shifter branch and another one of the antenna units are coupled in series.

5. The active phased array antenna system as claimed in claim 2, wherein in the hierarchical phase shifter circuit, a second one of the input signals is coupled to a second phase shifter branch of the hierarchical phase shifter circuit, the second phase shifter branch includes: q phase shifters of the first hierarchy to the P-th hierarchy of phase shifters, the q phase shifters and a second one of the antenna units are coupled in series, wherein $1 \leq q < P$.

6. The active phased array antenna system as claimed in claim 2, wherein the hierarchical circuit structure further comprises: a plurality of power divider/combiners, the P hierarchies of phase shifters are coupled via the power divider/combiners.

7. The active phased array antenna system as claimed in claim 1, wherein the hierarchical circuit structure comprises:

a hierarchical binary adder circuit, for generating a plurality of output phase control signals according to phase values corresponding to the phase control signals and combinations of the phase values, the hierarchical binary adder circuit includes a plurality of binary adders coupled hierarchically in P−1 hierarchies; and a plurality of phase shifters, coupled to the hierarchical binary adder circuit, for outputting the output signals according to the input signals and the output phase control signals.

8. The active phased array antenna system as claimed in claim 7, wherein the P−1 hierarchies of binary adders are for respectively receiving a first to a (P−1)-th phase control signal set in the plurality of phase control signals, wherein a k-th hierarchy of binary adders of the plurality of binary adders is for receiving at most $N_k$ phase control signals of the plurality of phase control signals, wherein $1 \leq k \leq P-1$, and the (P−1)th hierarchy of binary adders are further for receiving at most Np phase control signals of the plurality of phase control signals.

9. The active phased array antenna system as claimed in claim 8, wherein in the hierarchical binary adder circuit, a first phase control signal of a Pth phase control signal set of the plurality of control signals is coupled to a first binary adder branch of the hierarchical binary adder circuit, the first binary adder branch includes: P−1 binary adders respectively belonging to the first hierarchy to the (P−1)th hierarchy of binary adders, the P−1 binary adders and a first one of the phase shifters are coupled in series.

10. The active phased array antenna system as claimed in claim 9, wherein in the hierarchical binary adder circuit, another phase control signal of the Pth phase control signal set of the plurality of control signals is coupled to another binary adder branch of the hierarchical binary adder circuit, another binary adder branch is coupled to another one of the phase shifters.

11. The active phased array antenna system as claimed in claim 8, wherein in the hierarchical binary adder circuit, a second phase control signal of a Pth phase control signal set of the plurality of control signals is coupled to a second binary adder branch of the hierarchical binary adder circuit, the second binary adder branch includes: q binary adders of the first hierarchy to the (P−1)th hierarchy of binary adders, the q binary adders and a second one of the phase shifters are coupled in series, wherein $1 \leq q < P-1$.

12. The active phased array antenna system as claimed in claim 1, further comprising:

a control unit, coupled to the beamforming circuit, for outputting the plurality of phase control signals.

13. The active phased array antenna system as claimed in claim 1, wherein the beamforming circuit further comprises:

a plurality of attenuators, coupled between the beamforming circuit and the antenna units.

* * * * *